United States Patent [19]

Tkacsik

[11] Patent Number: 4,606,078

[45] Date of Patent: Aug. 19, 1986

[54] MATERNITY COAT AND BABY CARRIER

[76] Inventor: Mary C. L. Tkacsik, P.O. Box 9016, Virginia Beach, Va. 23450

[21] Appl. No.: 714,943

[22] Filed: Mar. 22, 1985

[51] Int. Cl.[4] ..... A41D 3/00; A61G 1/00

[52] U.S. Cl. ..... 2/84; 2/88; 2/94; 2/95; 2/102; D3/31; 224/160

[58] Field of Search ..... 2/84, 85, 88, 93, 94, 2/95, 102, 69, 69.5; D3/31; 224/160

[56] References Cited

U.S. PATENT DOCUMENTS

| | | | |
|---|---|---|---|
| D. 176,433 | 12/1955 | Stringini | D3/31 |
| D. 255,180 | 6/1980 | Raz | D3/31 |
| D. 266,800 | 11/1982 | Kula et al. | D3/31 |
| 2,368,272 | 1/1945 | Sydenham | 2/84 X |
| 2,411,331 | 11/1946 | Netteship | D3/31 X |
| 3,014,218 | 12/1961 | Smith | 2/84 X |
| 3,097,773 | 7/1963 | Cunningham | 224/160 |
| 3,327,914 | 6/1967 | Abram | D3/31 X |
| 3,523,302 | 8/1970 | Rabedeaux | 2/69.5 |
| 3,575,326 | 4/1971 | Chappell | D3/31 X |
| 3,989,173 | 11/1976 | Gebhard | D3/31 X |
| 4,079,467 | 3/1978 | Baldwin | 2/94 |
| 4,166,558 | 9/1979 | Schroeder | 224/160 |
| 4,271,998 | 6/1981 | Ruggiana | 224/160 |
| 4,469,259 | 9/1984 | Krich | 224/160 |
| 4,535,479 | 8/1985 | Paula | 2/69.5 |

*Primary Examiner*—H. Hampton Hunter

[57] ABSTRACT

An improved coat that has large sleeves and an oversized girth whereby the wearer of the coat may carry a child under the coat on either the wearer's front or back. An adjustable length belt blacks the passage of air into the coat, prevents articles stored in the sleeves under the coat from falling out, and pulls the fullness of the coat into the wearer so that coat may be worn by a single person. A deployable front hood is provided to protect the child when carried in the front. A deployable hood in the back of the coat provides protection to child and wearer when child is carried in the back. A baby carrier is provided that adequately accommodates a child from birth, through all growth stages, to as long as the parent wishes to carry the child. A vest worn in conjunction with coat is provided to protect wearer's shoulders against cold.

4 Claims, 24 Drawing Figures

103

19
17
19a
5
15
15a
5
17a
17a
18
18
16
5
5a
25
5
5a
25
26
22
16b
25
25
15
16C
26
22
23
23a

A

B

A

B

C

D

E

A

B

C

D

Back view figure 11
side view
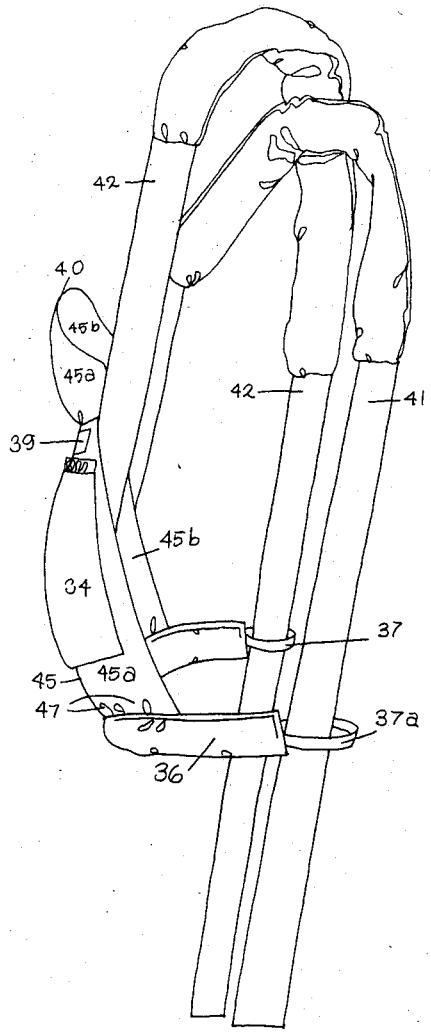
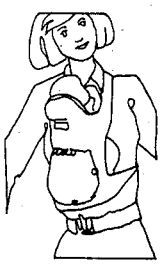
figure 12
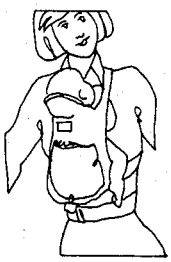
figure 13
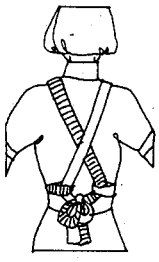
figure 14
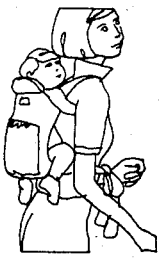
figure 15
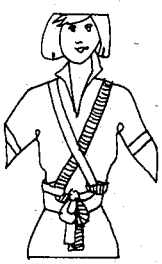
figure 16

MATERNITY COAT AND BABY CARRIER

FIELD OF THE INVENTION

This invention relates generally to baby carrying devices and specifically to a coat that covers the mother and the baby that is being carried, whether the baby is being carried in the belly or after birth in a carrier on the mother's front or back.

DISCUSSION OF PRIOR ART

Babies have been carried practically since the dawn of time in some fashion or other. Improvements in these baby carrying devices have been developed through the ages and new designs are still coming forth. The previous carriers while providing satisfaction in many areas, do not satisfy many requirements which has been found to be desirable. Hence, it is observed that a need existed for a new and improved method which achieves certain advantages that could not be achieved with the prior devices for carrying infants.

Several important deficiencies are found in the prior art. The first deficiency occurs when parents wich to take a small baby outside into cold, windy weather, for whatever the reason. In the coats that are presently available, the baby always has to be carried outside the parent's coat, unless the baby is very tiny. Usually, by the age of six weeks, the baby has grown too large to fit under the conventional coat. It has been observed that parents carry the baby in a carrier in the front position outside the wearer's coat and wrap a blanket around the baby in an attempt to keep it protected from the elements. This is not too satisfactory, as the blanket always seems to slip off.

The second deficiency exists because small babies find it very difficult to breathe, if not almost impossible, in extremely cold air or high winds. If the weather is pleasant but extremely cold, the baby will get chilled if he has to be carried for any considerable time, front or back. Thusly, the parents will not usually take a baby outside at all, except for an emergency.

The third deficiency exists whereby the mother being inclined toward outdoor sports or activities, eventually experiences resentment of the new baby which keeps her housebound until the weather modifies sufficiently for her to get out. Usually, to participate in an outdoor sport or activity, the mother has to find someone to leave the baby with. However, this presents a fourth deficiency for the mother who breast feeds and wants to leave for the day for such activities. To leave the baby at home requires pumping her breasts at specific intervals during the time spent away from the child. Since pumping can be somewhat painful, as well as inconvenient, rather than taking the baby with her into the cold and perhaps jeopardizing his health, she usually elects to stay at home.

The fifth deficiency exists whereby the prior art has not taken into full account the psychology of newborn infants, as well as the mother carrying the infant. During pregnancy, the foetus constantly hears the mother's voice, heartbeat, and is continually rocked by her movements of walking. After birth, the presently accepted practice involved in taking a baby outside, is to put the baby into one of the plastic infant seats, wrap him in blankets, and carry the contraption awkwardly in her arms. This results in the mother's arms quickly tiring, and the device becoming very heavy after a short itme. If the seat device has a carrying handle, it is not so tiring for the arms. The baby brought outside wrapped for protection against the elements in such a manner, usually has the blankets covering his head. An anxious mother is always unwrapping the blankets to check if baby is still alright and breathing. This allows for a rush of cold air to be drawn into the baby's lungs, which makes it cough, choke, and perhaps momentarily stop breathing. If the practice of carrying the child in a carrier outside the mother's coat covered with a blanket is employed, the child can perhaps still hear the heartbeat, can probably hear the voice, is certainly rocked by her movements, but will not be cozily warm in a simulated womb environment.

This invention overcomes the deficiencies found in the prior art by providing maximum protection for the baby from rain, snow, wind or cold air; by providing womb security tightness for the infant in a carrier under the coat; by providing warmed air from the air trapped under the coat for the baby to breathe, yet also providing sufficient air flow for adequate replacement; and by providing a carrier that adapts to the needs of the growing infnat while being carried under the coat.

OBJECTS

Accordingly, it is the object of the invention to provide a large, roomy coat that a mother can wear during the last big bellied stages of pregnancy and that remains functional to the mother after the birth of the child.

Another object of the invention is to provide a coat of the character described which will satisfy the mother's desire for something practical, yet fashionable, have high quality construction, and ease of manufacturing.

It is further the object of the invention to provide a coat that will cover both the baby and the mother whether the baby is carried in an infant carrier on her front or back.

Another object of the invention is to provide a coat that offers maximum comfort and protection against the cold, hostile environment of cold, windy, winter weather and be the means by which parents can take their infant with them on their adventures, initiating the baby to the pleasureable emotions generated by outdoor activities, from his earliest months.

A further object of the invention is to provide a coat which will not only cover both the baby and the mother, but also one that the mother can adjust in such a manner as to be able to wear the coat just for herself.

It is also the object of the invention to provide a strong, flexible, cloth carrier which is the means whereby the mother can secure the infant under the coat, on her front or back. This carrier will adequately accomodate all growth stages.

It is further the object of the invention to provide a carrier that has optimum comfort in it's weight distribution to reduce fatigue for the person carrying the infant in either the front or back position.

Another object of the invention is to provide a carrier that has an attractive design, high quality and strength, simple construction and manufactured economically in the same or contrasting colors to the coat.

It is finally the object of the invention to provide a carrier that can hold a child from birth to as long as the parent wishes to carry the child under the coat, so as to make a satisfying, comfortable, practical, functional method of carrying an infant anywhere, anytime, in any kind of weather.

Other objects, advantages and capabilities of this invention will become apparent as the description proceeds, accompanied with the drawings.

DRAWINGS

FIG. 11 is a perspective view showing the side of the carrier.

FIG. 12 is a modelled view showing a newborn just in the seat of the carrier.

FIG. 13 is a modelled view showing an older baby in the front position in the carrier.

FIG. 14 is a modelled view showing how the straps of the carrier are tied in the back.

FIG. 15 is a modelled view showing the baby in the back position in the carrier.

FIG. 16 is a modelled view showing how the straps of the carrier are tied in the front.

DESCRIPTION

Figure 1:
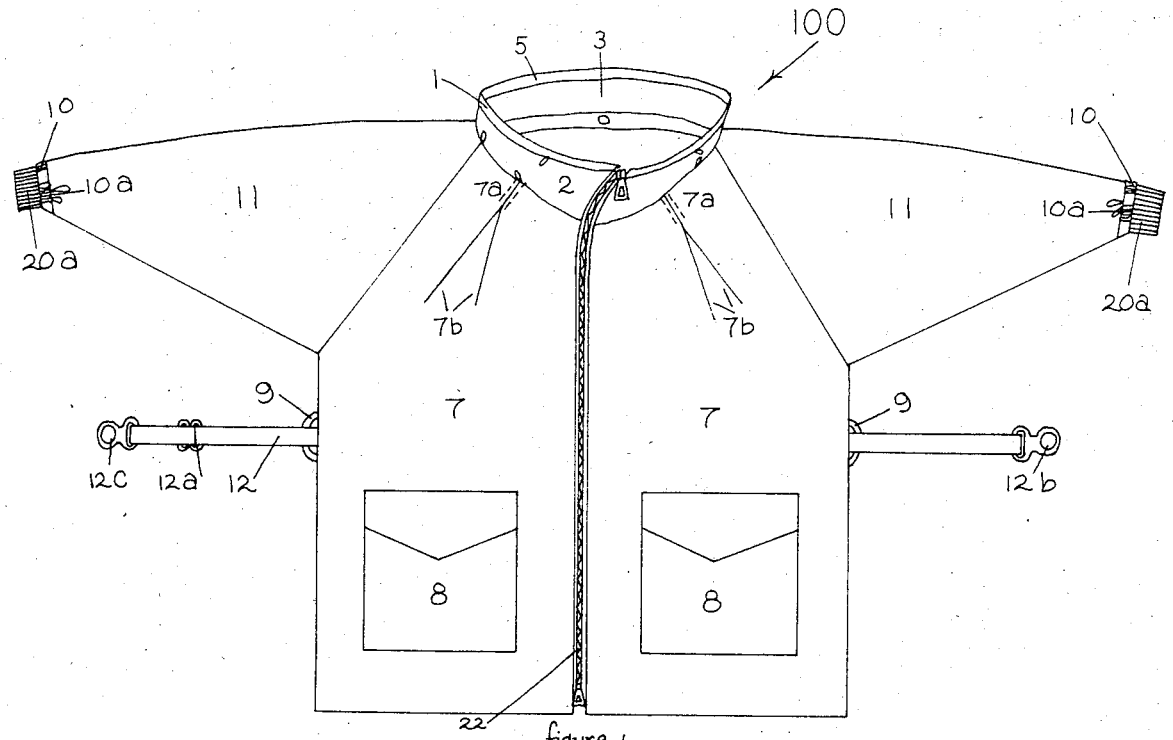
FIG. 1 is a perspective view showing the front of the coat.
Figure 2:
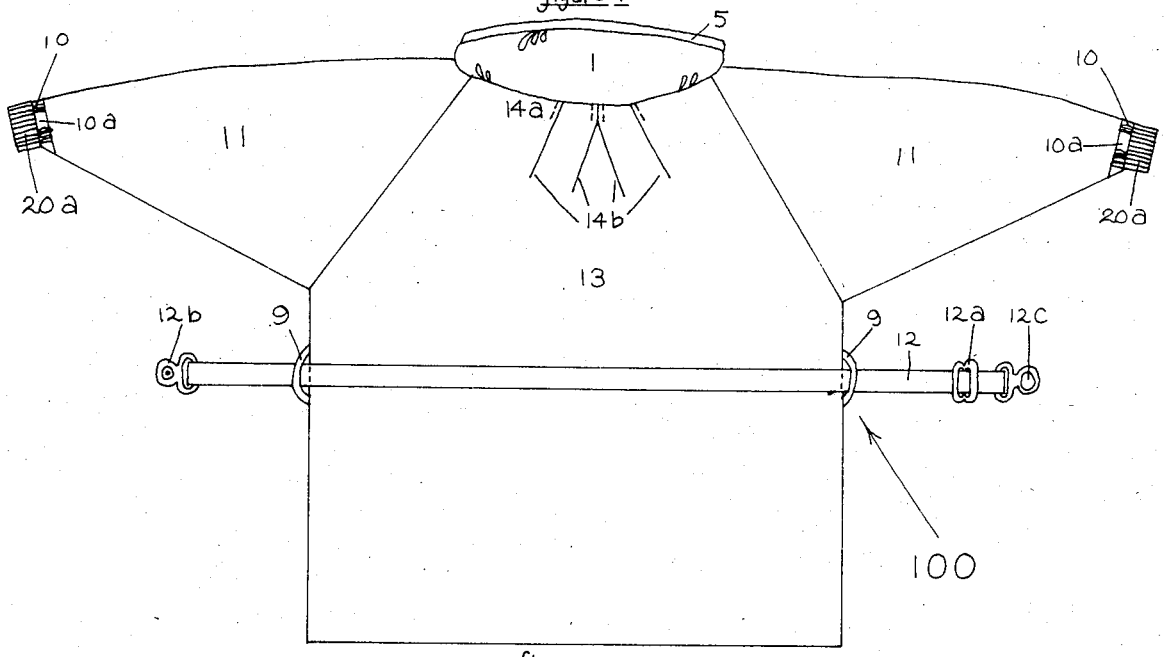
FIG. 2 is a perspective view showing the back of the coat.

What I am about to describe is, in fact, the preferred embodiment. This is the way I find is best.

There are three basic parts: an improved coat generally noted in the drawings as (100); a vest, generally noted in the drawings as (101); and a baby carrier, generally noted in the drawings as (102.)

THE COAT

Referring to FIGS. 1–5, the coat (100) has these main parts: an outside shell fashioned out of a lightweight, wind proof, water resistant fabric, consisting of two front panels (7), one back panel (13), collar (1), sleeves (11), zipper (22), front baby hood panels (**16*b*) and (16*c*), large back hood (103) divided into a baby hood (16*a*) and hood for the mother (17); a removable lining fashioned from a warm batting quilted onto the same type of fabric as the shell which consists of: lining sleeves (20), front lining panels (21*a*), back lining panel (21); and a belt (12**).

The collar (1) is made out of two pieces of fabric, havng an inner collar panel (3) and an outer collar panel (2). The collar (1) is stitched to the front panels (7), the large sleeves (11), and the back panel (13). The collar has velcro (5) stitched around the top, so that collar panels (2) and (3) can be opened or closed. Baby hood panels (**16*b*) and (16*c*) are attached at (34) to the right and left sides respectively, of the outer collar panel (2) and are stored between collar panels (2) and (3). The side of the baby hood panels (16*c*) and (16*b*) facing the rear baby hood (16*a*) has an elastisized band (15) stitched into that edge to pull the panel into a curve. The edge at 90° to the edge (15) has a dart (25) stitched into the edge (5*a*) to pull it into a curve. There is also an extra piece of fabric stitched over the edge (5*a*) to "face" it and make it sturdier to better hold the Velcro (5) that is stitched onto the edge (5*a*), to open and close the panels (16*b*) and (16*c***) over the baby's head.

Figure 8:
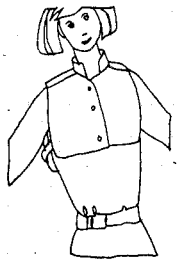
FIG. 8A is a modelled view of the vest shoulder covering showing the front of the vest.
FIG. 8B is a modelled view of the vest shoulder covering showing the side of the vest with the hood deployed.
FIG. 8C is a modelled view showing the baby being carried on the back under the coat.
FIG. 8D is a modelled view showing the baby being carried on the back under the coat and the hood of the vest deployed.
FIG. 8E is a modelled view showing the baby being carried on the back with the large rear hood for two persons deployed.
Figure 8:
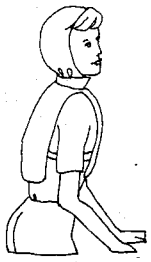
Figure 8:
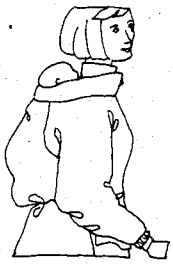
Figure 8:
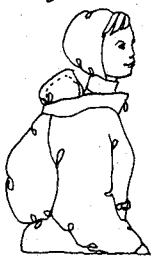
Figure 8:
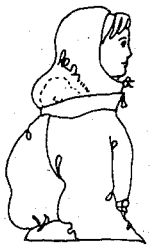
Figure 9:
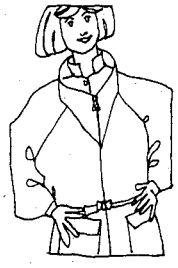
FIG. 9A is a modelled view showing the front of the coat when worn just as a regular coat with the fullness pulled in by the belt.
FIG. 9B is a modelled view showing the front of the coat worn while the mother is pregnant.
FIG. 9C is a modelled view showing the baby being carried on the front under the coat.
FIG. 9D is a modelled view showing the baby being carried on the front with the front hood deployed. Outline of the baby indicated by the dotted line.
Figure 9:
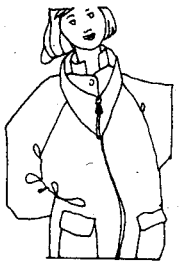
Figure 9:
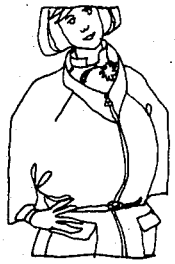
Figure 9:
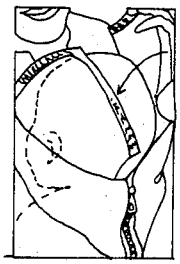

The front baby hood panels (**16*b*) and (16*c*) may be taken out for use by opening the Velcro (5) stitched to the top of the collar panels (2) and (3) and placed over the top of the baby's head. The Velcro (5) stitched to the tops of the baby hood panels (16*b*) and (16*c*) is then pressed together to close the panels (16*b*) and (16*c*) over the top of the baby's head (as shown in FIG. 9D). The large rear hood (103) is attached at (34) to the outer collar panel (2) at the rear or middle of the collar (1) and stored inside the collar panels (2) and (3). This hood (103) may also be taken out for the use by opening the Velcro (5) on the top of the collar panels (2) and (3) and placed over the top of the baby's and the mother's heads (as shown in FIG. 8E). The rear baby hood (16*a*) has six grommets (18) implanted into the fabric. Mother hood (17) has an elastisized band (15) threaded into the casing tube (15*a*) in the middle of the hood (103) to pull the fullness close to the head into a loose fitting cap, and two flaps (17*a*) which curve around the neck and fasten together under her chin with the Velcro (5) on the edge of these flaps. The hood (103) has the edge turned under to form a casing tube (19) into which the drawstring (19*a*) is threaded. By pulling the drawstrings (19*a*) the hood is closed tightly around the mother's face (as shown in FIG. 8E**).

The front panels (7) have a tuck (**7*a*) taken in the top of them so as to form a soft fullness (7*b*) in each side of the front panels (7) thereby providing sufficient roominess for the large belly of late pregnancy (as shown in FIG. 9B), or for carrying an infant underneath the coat (100) in the front (as shown in FIG. 9C). There are two large patch pockets on each side of the front panels (7) for hand warming or for carrying items. The front panels (7) are stitched to the collar (1), the sleeves (11), and the back (13). A large-tooth separating zipper (22) is sewn onto the open edge of each front panel (7) by which the coat (100**) is opened or closed.

Belt loops (9) for receiving the belt (12) are attached to the front panels (7) and are located at the junction of the sleeves (11), the back panel (13), and the front panels (7) of the coat (100). The belt is made out of one long piece of the same kind of fabric as the outside shell of the coat (100). It is then folded lengthways in half. A webbed, belt stiffening material is inserted along the fold, the outside edges turned under, and the whole thing stitched together. One end of the belt is stitched to the first part of the separating buckle (12*b*) and the free end of the belt (12) is then threaded through the slider (12*a*). The slider (12*a*) is pulled onto the belt (12) and the free end of the belt is then slipped through the loop of the second part of the separating belt buckle (12*c*), folded under, threaded through the bottom part of the slider (12*a*) and sewn into place. This design allows easy adjustment of the length of the belt (12).

Sleeves (11) are provided with an elastisized band (10) which is threaded into a casing tube (10*a*) formed at the ends of the sleeves (11) by turning under some of the fabric and stitching it into a casing tube. The sleeves (11) are attached to the front panels (7), the back panel (13) and the collar (1) of the coat (100).

The back panel (13) has three tucks (14*a*) taken in the top of the back panel (13) so as to form a soft fullness (14*b*) in the middle of the back panel (13) to provide a sufficient roominess for carrying the infant underneath the coat (100) in the back as shown in FIGS. 8C, 8D and 8E. It is stitched to the sleeves (11), the front panels (7) and the collar (1) of the coat (100).

The detachable lining consisting of: the front panels (21*a*), the back panel (21) and the lining sleeves (20) are stitched together at the shoulders and sides. Snaps (23) are implanted into the fabric at the side open edge of the lining panels (21*a*) and the top of the back panel lining (21). A facing (23*a*) on the inside edges of the front panels (7) is sewn in place at the same time the zipper (22) is sewn onto the front panels (7). Corresponding snaps (23) are implanted into the facing (23*a*) that matches the position of the snaps (23) in the lining panels (21*a*) and the top of the back panel lining (21). The lining is then snapped to the corresponding snaps to form the whole coat (100). The lining may be removed by unsnapping the panel lining (21*a*) and the back panel (21) lining from the corresponding snaps in the facing (23*a*) (as shown at (24)). Elastisized cuffs (20*a*) are sewn onto the ends of the lining sleeves (20) and protrude beyond the end of the sleeves (11).

THE VEST

Figure 6:
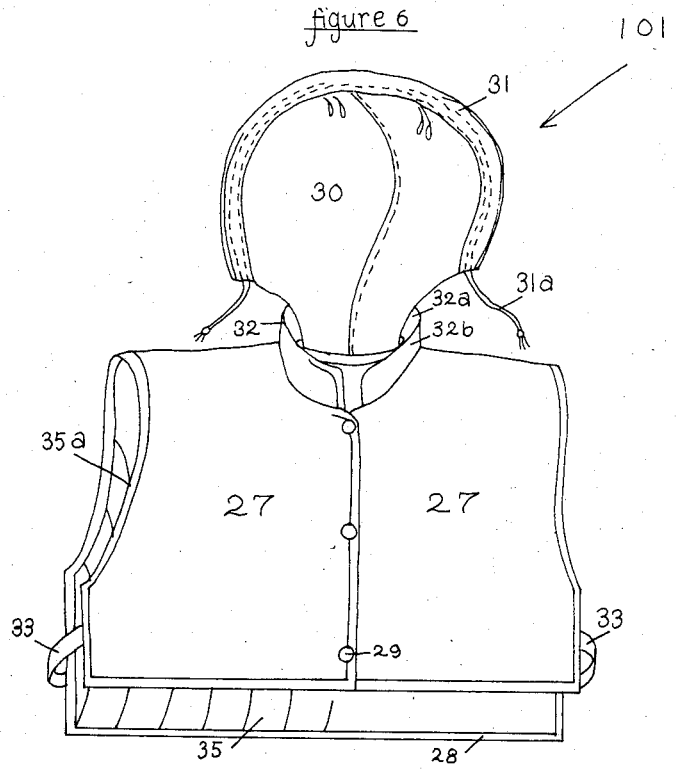
FIG. 6 is a perspective view showing the vest shoulder covering with the hood deployed.
Figure 7:
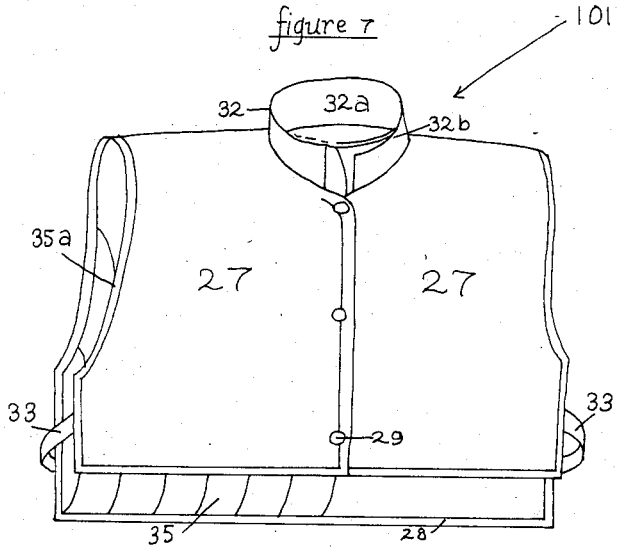
FIG. 7 is a perspective view showing the vest shoulder covering.

Referring to FIGS. 6 and 7, the vest (101) has these main parts: an outer shell of lightweight, windproof, water resistant fabric consisting of two front panels (27), one back panel (28), collar (32), and hood (30); an inside lining of warm batting quilted onto the same type of fabric consisting of: two lining front panels (35*a*) and a back lining panel (35). The front panels (27) are stitched to the back panel (28) at the shoulders. The collar has two collar panels (32*a*) and (32*b*) sewn together and stitched to the front panels (27) and the back panel (28). The middle third of the bottom of the hood (30) is stitched into the middle of the top of the back panel (28) and stored between the lining (35) and the back panel (28). The outside edge of the hood (30) is formed into a casing tube (31). The drawstring (31*a*) is threaded into the casing tube (31). The back lining (35) and the front lining panels (35*a*) are sewn together at the shoulders. The front lining panels (35*a*) and the back panel (35) and the front panels (27) of the shell and the back panel (28) are then all stitched together to form the vest (101) of the coat (100). The elastic band (33) is stitched to the front panels (27) and the lining front panels (35*a*) under the arm, to hold the vest (101) in place on the shoulders. The snaps (29) are implanted into both fabrics of the front panels (27) and the lining front panels (35*a*) to form the method to open and close the vest (101).

THE CARRIER

Figure 10:
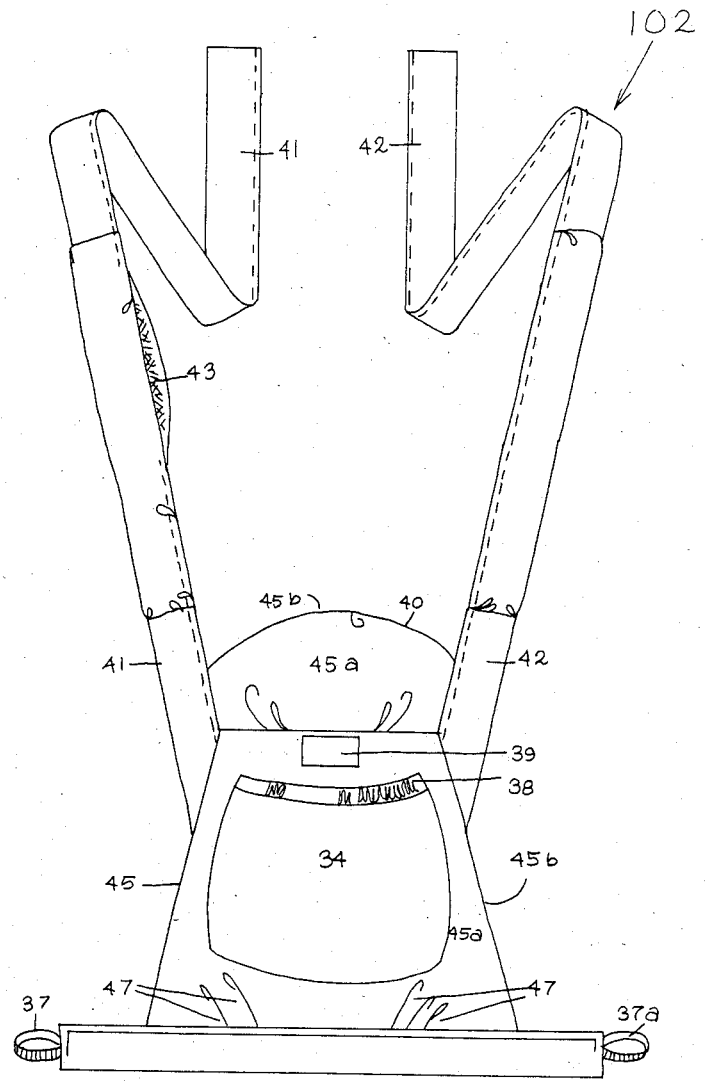
FIG. 10 is a perspective view showing the back of the carrier.

Referring to FIGS. 10 and 11, the baby carrier (102) has these main parts: two long straps (41) and (42), headpiece (40), a seat (45), patch pocket (34), waistband (36), two loops (37) and (37*a*), padding (43) in the straps (41) and (42), and padding in the waistband (36). It is seen that the carrier (102) is simple in construction. It is fashioned from a soft, strong, flexible fabric thereby being easily folded to fit pocket or purse. The fabric is machine washable and dryable for ease in cleaning whenever necessary. The seat (45) and the headpiece (40) may be cut from one piece of fabric. It is approximately 16 inches in length and 11 inches across the seat (45) at the bottom narrowing to 9 inches at the middle of the seat (45) and widening to 11 inches at the headpiece (40). There is an outside panel (45*a*) and an inside panel (45*b*). The inside panel (45*b*) is generally constructed of fabric that is softer in texture than the outer panel (45*a*) since it is next to the baby. The straps (41) and (42) are approximately 60 inches in length and 5 inches across, also cut from one piece of fabric, for optimum strength. Straps made of several pieces joined together are also possible, but inherently not as strong. These straps are folded along their length in half, the open edges turned under, a padding (43) inserted inside (as shown in FIG. 10) the fold to cushion the shoulders against the baby's weight in the carrier (101), and stitched together to close the open edges. The straps (41) and (42) are then sewn to the outside panel (45*a*) at the junction of the seat (45) and the neckpiece (40). The pocket (34) (approximately 8 inches by 6 inches) and the label (39) are also sewn to the outside panel (45*a*). The straps (41) and (42) are arranged in such a manner that they extend down the middle of the outside panel (45*a*). The inside panel (45*b*) is placed over the straps (41) and (42) and the outside panel (45*a*), their edges identically matched, and the outside edges are stitched together. The straps (41) and (42) are then pulled out from under the two panels (45*a*) and (45*b*) causing everything to turn right side out. The straps (41) and (42) are stitched to the side edges of the neckpiece (40) as shown in FIG. 10). This gives the headpiece (40) stability for the head support of the baby. Four little tucks (47) are taken in the bottom middle of panel (45*a*) and panel (45*b*) to produce a roundness at the bottom of the seat (45) (as shown in FIG. 11). There can be more tucks making the roundness deeper, but there should not be any less. The waistband (36) approximately 21 inches long by 5 inches is cut from one piece of fabric. It is folded lengthways in half (as were the straps) and the padding (43) which is approximately 20 inches long by 2 inches wide is placed in the center fold. The loops (37) and (37*a*), which are approximately 5 inches long and 1 inch wide are folded into thirds and stitched together forming a very strong fabric loop. These are then stitched to the ends of the waistband (36). The same fabric as the carrier (102) is used rather than metal "O" or "D" rings because metal has the distinct tendency to be an stay cold. The waistband (36) is then stitched to the bottom of both seat (45) panels.

These dimensions have been found to be quite satisfactory in the construction of carrier (102). The carrier is exceptionally comfortable for both the mother and the baby. There are no tucks to take in or out to fit the growth stages of the child. The carrier is easily adjusted to fit different size babies. The one carrier fits from birth to as long as the parent wishes to carry the child. cl

OPERATION

Operation of the Coat

All coats have the same basic parts which are: two front panels opened and closed by adequate manner, a back panel, two sleeves and a collar. Some coats have hoods and some do not. As noted above, there is no prior coat generally made for two people, unless of course, it is something that is specifically needed as for example, inseparable siamese twins.

The improved coat (100) has the same basic parts and features of a regular coat, the difference being that the basic coat parts in the coat (100) were designed to form a style coat that can be used for one or two persons (one person being an adult and the other being a child in various stages of growth).

Referring to FIGS. 1–5: Most coat collars are mainly for decoration. In some cases the collars become functional, fluffing or elongating around the neck and face in some manner, for added warmth. The collar on the coat (100) has, in some instances the docorative function. However, the collar (1) on the coat (100) is for the neck and head support for the infant being carried in the carrier (102) in the front position (as shown in FIGS. 9C and 9D) and the back position (as shown in FIGS. 8C, 8D, and 8E).

The collar (1) is made out of two pieces of fabric, having an inner panel (3) and an outer panel (2). In the front of the collar (1) two baby hood panels (16*b*) and (16*c*) are sewn under the velcro (5) that is stitched into the top of both the collar panels. When the mother needs to protect the baby from the elements, she opens the Velcro (5) at the top of the collar (1), pulls out the baby hood panels (16*b*) and (16*c*) and positions them over the baby's head (as shown in FIG. 9D). The Velcro (5) on each side panel is pressed together to form a cap that will block the cold wind, rain or snow from reaching the baby. The air that is now trapped under the cap and the coat (100) is warmed by the combined body heat. Now the baby has warm air to breathe, yet the cap is loose enough to allow adequate replenishment of fresh air.

Figure 3:
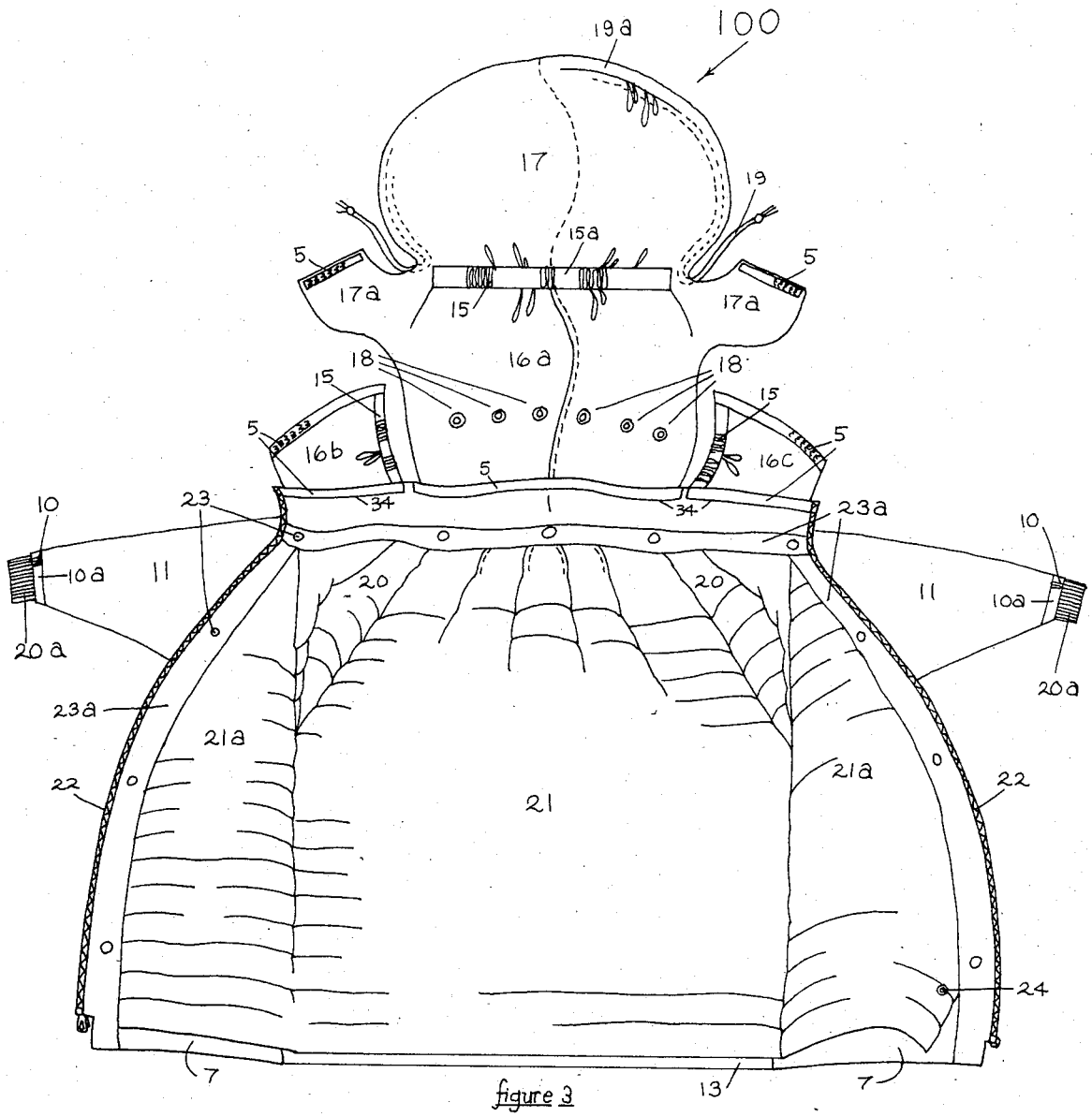
FIG. 3 is a perspective view showing the open coat with the front and rear hoods deployed.
Figure 4:
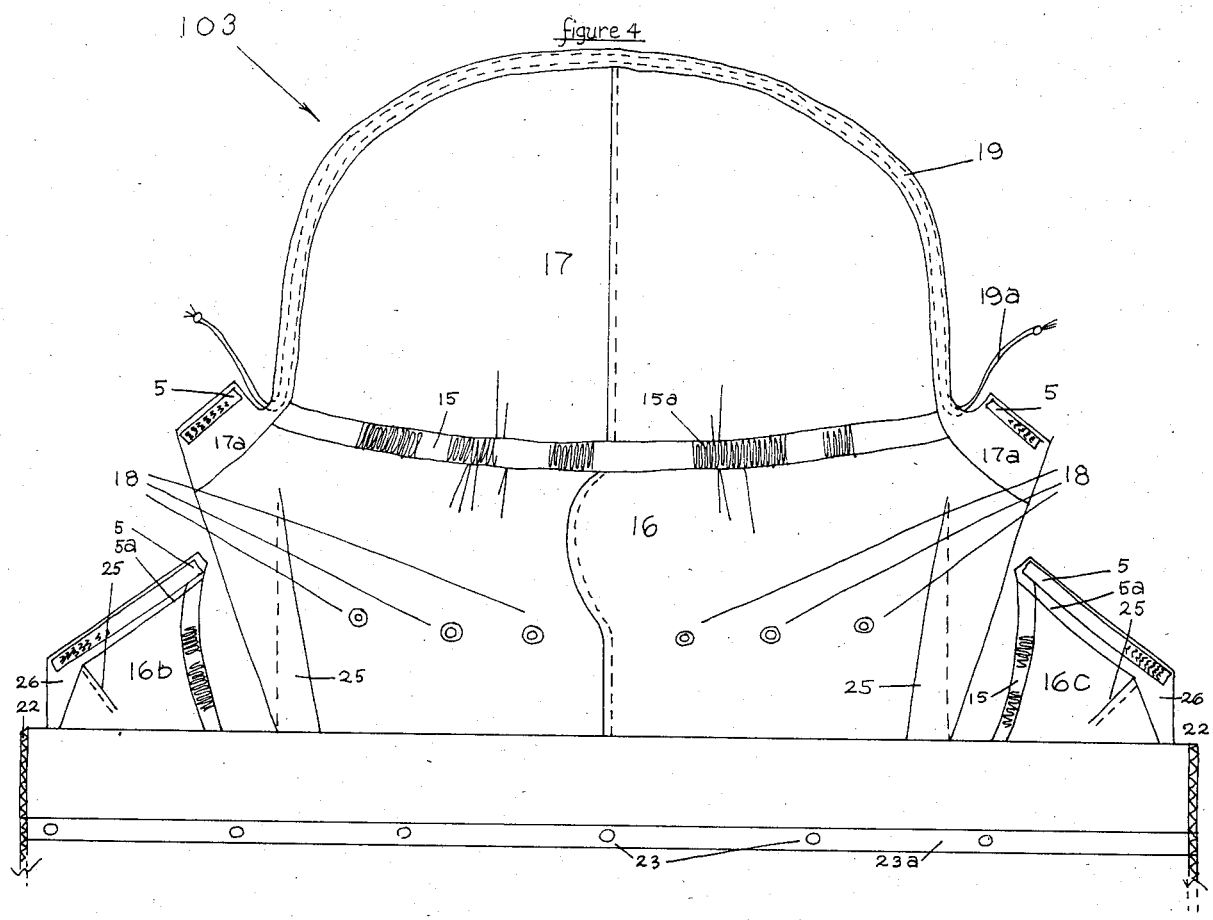
FIG. 4 is a perspective view showing an enlargement of the front and rear hoods deployed.
Figure 5:
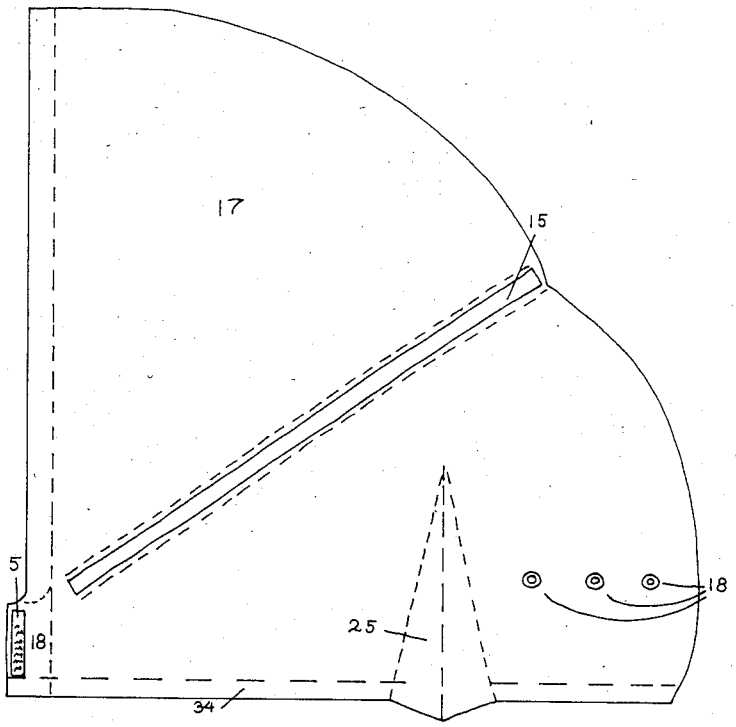
FIG. 5A is a perspective view showing the pattern piece of the rear hood.
FIG. 5B is a perspective view showing the pattern piece of the two small front baby hoods with the facing.
Figure 5:
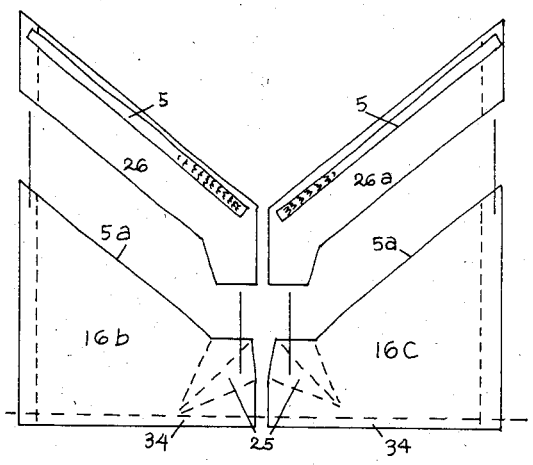

If the weather turns from pleasant to unpleasant while the baby is being carried in the back position (as shown in FIG. 8C and 8D) she opens the Velcro (5) at the middle top of the collar (1), pulls out the big hood (103) that is stored between the collar panels (2) and (3) (as shown in FIG. 3) and positions the baby hood (16*a*) over the baby's head and the hood (17) over her head (as shown in FIG. 8E) to protect them both from the bad weather conditions. The baby can now breathe in the warmed air trapped under the coat (100). The airholes (18) (see FIGS. 4 and 5A) insure an adequate replenishment of fresh air.

The front panels (7) of the coat (100) differ from a regular coat by the tuck (7*a*) at the top of the front panels (7). The tuck (7*a*) produces the folds (7*b*) that cause the front panels (7) to flare out at the bottom. The one tuck (7*a*) to produce the folds (7*b*) is the preferred embodiment. It could be a wider piece of fabric and have more tucks thereby causing a fuller bottom panel. Or there can be a smaller piece of fabric and not have any tucks. This would cause the bottom of the panel (7) to be tighter, thus reducing the comfort factor. The one tuck (7*a*) seems to be just about right to produce the folds (7*b*) that easily accomodates the big bellied stages of advanced pregnancy (as shown in FIG. 9B). A regular coat usually does not have this feature. Women in the advanced stages of pregnancy have been observed with a regular style coat tightly stretched around their big bulges. After birth, the coat (100) will easily adjust to accomodate the movement of the big bulge from the belly area to the chest area, where the baby is now being carried in the carrier (102) unde the coat (100) on the front (as shown in FIG. 9C).

The back panel (13) has three tucks (14*a*) to produce the folds (14*b*) that easily encompass the infant under the coat (100). This is the preferred embodiment. It could have more tucks to produce a fuller back panel. So doing would shorten the breadth of the back panel (13) across the shoulders. A wider piece of fabric would have to be cut to keep the same breadth across the shoulders. Or it could have less tucks. Less tucks would produce a broader breadth across the shoulders and lessen the deepness of the folds (7*b*), thus making the material too tight to wear the baby on the back in the carrier (102) under the coat (100) comfortably (as shown in FIGS. 8C, 8D, and 8E). A regular coat would absolutely prohibit a baby being carried in a carrier in the back position. Only in the case of a specific back deformity would a coat be thus tailored.

The sleeves (11) of the coat (100) have been cut in the Dolman style. There is an elastisized band (10) on the ends of each sleeve (11) to pull the ends of the sleeves (11) comfortably tight around the wrists. This sleeve fullness, in conjunction with the fullness of the front panels (7) and the fullness of the back panel (13) easily allow the entire coat (100) to encompass the child being carried in the carrier (102) in either the front or the back position. The sleeves (11) can also function as a storage as a storage facility for carrying extra supplies of baby needs on short trips, thus eliminating the need for an extra diaper bag. To prevent these supplies from falling out of the bottom of the coat (100) the belt (12) is comfortably tightened around the hanging legs of the child being carried in the carrier (102) under the coat (100) and the mother's waist (as shown in FIG. 15 illustrating the hanging legs of the child).

The belt (12) is threaded through the belt loops (9). The belt (12) is long, and has been designed with the slider (12*a*) to facilitate adjustments in length. The slider (12*a*) eliminates the annoyance of the end of a belt, adjusted in the traditional method of a belt buckle being inserted into different holes from hanging down and inconviencing the wearer.

For certain uses of the coat (100) the belt (12) is not necessary. The coat (100) can function adequately without it. Without the belt (12) though, certain functions cannot be accomplished. For example, the fullness of the coat (100) is pulled in by shortening the belt (12) to enable the mother to wear the coat (100) as just a regular coat (as shown in FIG. 9A). In this style, the collar (1) is a docorative collar which hangs attractively in a cowl collar design (as shown in FIG. 9A). A different lenth of the belt (12) is required to comfortably tighten the coat (100) and keep the stored items in the sleeves (11) from falling out. If the baby is carried in the carrier (102) under the coat (100) on the front, still another length of the belt (12) is necessary, and so on. Any long belt would function adequately, but the design explained, is the preferred embodiment.

The patch pockets (8) that are sewn to the front panels (7) are for the same purpose on the coat (100) as they are on any coat.

The coat (100) also has front lining panels (21*a*) back lining panel (21) and the lining sleeves (20). The lining performs the same function as ordinary coat linings. These parts are made in the same configurations as the front panels (7), the back panel (13) and the sleeves (11) for the same purpose of encompassing the infant in the carrier (102) easily. The elastisized cuffs (20*a*) are sewn to the ends of the lining sleeves (20) rather than to the outside shell sleeves (11). Even though the whole coat (100) was primarily designed to combat cold, wintry weather, sometimes in less severe weather the only protection needed is something that will keep the wind off the baby. At these times, the lining can be removed by unsnapping the snaps (23) as shown in FIG. 3 point #24, and the coat becomes just a windbreaker.

OPERATION OF THE VEST

The main function of the collar (1) of the coat (100) is to provide neck and head support for the infant being carried in the carrier (102). The head of the infant must protrude slightly above the collar, thereby making it difficult to snug the collar (1) close to the mother's neck. It will be appreciated that there is a wide opening around the top of the collar (1) through which the cold air may penetrate or the wind whistle, into the coat (100) thereby causing the mother's shoulders and neck to get very cold during winter. Because this occurs, one modification of my invention is to add a vest that will keep the shoulders and neck warm. During the spring and fall or less severe weather, this modification is not necessary. In fact, it is not necessary at all. Heavy sweaters or scarves can be worn for protection. However, one of the objects of my invention is to provide a means whereby the mother can have comfort while she is outside in cold, wintry weather. It thereby strongly recommend that the vest (101) be used with the coat (100) to provide maximum protection and comfort.

The vest (101) as shown in FIGS. 6, 7, 8A and 8B, is designed mainly as protection for the shoulders. It does not need sleeves or entension to the waist. Accordingly, the vest (102) is made sleeveless and short enough to accommodate a nursing mother. The small, stand-up mandarin collar is for decoration only. The three snaps (29) open and close the vest. The elastic bands (33) located under the arms hold the front and back sides of the vest (101) together, and keep it from falling off the shoulders.

The lining of the vest (101) is not removable as it is in the coat (100), the inside lining and the outside shell being sewn together. In the back of the vest (101) there is a hood (30) which is sewn at about the middle three inches of the bottom of the hood (30) to the middle of the back panel (28). It is easily accessible. When the baby is in the hair pulling stage mother pulls out the hood (30) and places it over her head to keep her hair from being pulled out by little baby handfuls (as shown in FIG. 9D). The hood (30) can also be used just as a head covering during the less severe weather.

OPERATION OF THE CARRIER

Infant psychological research has shown that it is imperative for babies to be tactilely stimulated by continual close contact with the mother. For proper mental development and bonding, he must be supported in a manner in which the infant is held in simulation of his mother's arms. When an infant is placed in the carrier (102) and tied to his mother as soon after birth as the mother feels able to be up and around, he will experience the security of being tied into a close space, that simulates the closeness of the womb. The ancient practice of swaddling clothes that completely wrapped the baby into a simulated womb closeness that warmth, was a similar psychological simulation. The carrier (102) further simulates womb security because the baby still hears his mother's voice and heartbeat, and still is rocked continually by her walking, rocking movements.

The mother also benifits from the carrier (102). The baby is tied to her in such a manner that his head is supported on her breast. A very young infant needs to face inward for body and head support and emotional security. This position enables the mother of conscious or subconscious monitoring of the baby's breathing and easy observation of the mouth and nose area. This is particularly important when the baby is in the carrier (102) under the coat (100). Both the mother and the baby are psycologically satisfied because each can feel the other (tactile stimulation). The mother can respond to the baby's various needs immediately. With baby facing inward breastfeeding in the carrier (102) may be also accomplished.

Referring to FIGS. 12–16: The baby carrier (102) is simple, yet effective, in construction. It works satisfactorily from newborns to however long the parent wishes to carry the child. When the baby is newborn, he will fit just inside the seat (45) in his old familiar fetal position (as shown in FIG. 12). The older baby straddles his mother's waist (as shown in FIG. 13) with his legs hanging down over the waistband (36). This position holds the legs and hips in a manner that insures proper development and flexibility, which is not achieved of the legs are allowed to hang straight down as in carriers with leg holes. Babies also seem to grow out of leg hole carriers before the parent wishes to stop carrying them.

The straps (41) and (42) criss cross over the shoulders and pass through opposite side loops. They are then pulled comfortably tight for both persons, and tied in a knot or bow (as shown in FIGS. 14 and 16). This ensures that the baby will not fall from the carrier, no matter how small. The babies arms pass under the straps (41) and (42) when young (as shown in FIG. 13). The older baby holds his arms above the straps (41) and (42) (as shown in FIG. 15). These straps also provide stability for the headpiece (40) to ensure proper support for the infant's head and neck.

It will be appreciated that any of the prior art fabric carriers could be used with the coat (100) as they are all of good design. However, all of the prior art carriers either sling the baby too low for proper head/neck support offered by the collar, or the carriers are designed for maximum protection outside a coat and thus would make a baby too hot for under the coat (100). It is therefore recommended that carrier (102) be used with the coat (100).

It will therefore be appreciated that the invention of the combinations of the coat (100), the vest (101) and the carrier (102) with the described embodiments are the answers to the dilema of how to take a small baby into a cold environment. From the above discussion, it will be appreciated that the mother no longer has to stay housebond feeling resentful towards the baby that keeps her there. With this three part invention, she can now take her infant out into this cold environment and stay out for hours or days at a time, for whatever the reason, if she so desires. She can continue on with her choice of outdoor activities limited only by her own physical condition. There is now, no more danger of the baby freezing his face when he is in the drooling stage, as was observed once. Under the coat, the air is warm not freezing and bitterly cold. Under the coat in the carrier, the wind cannot reach the infant to interfere with his breathing. With this invention, the mother simply tucks her infant into the carrier, under the coat, and away they go, with a minimum of fuss. Mother can now take her little adventurer with her from the baby's earliest months in such a manner that is satisfying and pleasureable for them both. Therefore, it can be appreciated from the above discussion, that these early transition experiences from the inside body security to the outside body world, security provided by the carrier (102) and the warmth assurred by being carried under the coat (100) helps lead to a very secure, happy older child. Conversely, it may be appreciated from the above discussion, that the ease with which the mother can carry the infant in the carrier (102) under the coat (100) in combination with the shoulder modification protection of the vest (101) leads to a very secure, happy mother.

While the above description contains many specificities, these should not be construed as limitations on the scope of the invention, but rather as an exemplification of one preferred embodiment thereof. Many other variations are possible, for example when I talk about windproof, water resistant fabric, it could be a porous fabric, or waterproof. Where I talk about a soft fabric, it could be stiffer. Or zippers could be used in place of the Velcro, or buttons or Velcro could be used in palce of the snaps. Obviously any type of fabric would work, whether it be cotton, nylon, denim, corderoy, blends or wools. Any type of opening and closing mechanism could be used. Accordingly, the scope of the invention should be determined not by the embodiments illustrated, but by their appended claims and their legal equivalents.

I claim:

1. A coat suitable to fit over two persons, the first person being the wearer of the coat and the second person being smaller than, and is carried by, said first person comprising:

a garment body being of sufficient girth to extend substantially completely around said first and second persons;

a pair of sleeves attached to said garment body and extending from said garment body;

an opening in the front of said garment body extending from the bottom of said garment to the top of said garment body;

mechanical means by which said opening in the front of said garment body may be opened or closed;

a collar at the top of said garment body; said collar comprising of an inner collar panel and an outer collar panel;

the bottom of said inner collar panel and the bottom of said outer collar panel being stitched to said garment body;

and means by which the top of said inner collar panel may be temporarily fastened to the top of said outer collar panels;

a deployable front hood;

the bottom of said hood being sewn to said collar in the front of said garment body and between said inner collar panel and said outer collar panel; whereby said deployable front hood may be worn by said second person when said second person is carried in the front of said first person;

a deployable back hood;

the bottom of said back hood being sewn to said collar in the back of said garment body and between said inner collar panel and said outer collar panel; said back hood being of sufficient length to cover the heads of said second person and said first person when said second person is carried on the back of said first person;

and each of said sleeves being tapered from relatively larger sleeve circumference at the point of said attachment of said sleeve said garment body, to relatively narrower sleeve circumference at the outmost extremity of said sleeve.

2. The invention according to claim 1 further comprising an adjustable length belt.

3. The invention according to claim 2 further comprising a hooded vest, whereby, said vest is worn by said first person underneath said coat.

4. The invention according to claim 3 further comprising a baby carrier by which means said second person may be carried by said first person comprising, a trapezoidal fabric seat;

a pair of fabric straps extending from said seat; said straps being connected to the top of the sides, respectively, of said trapezoidal seat;

an elongated waistband connected along the length of said waistband to the base of said trapezoidal seat;

a pair of fabric loops connected to the terminal ends, respectively, of said waistband; and a fabric member connected to the top of said trapezoidal seat and to said straps by which means the head of said baby is supported.

* * * * *